US007387344B2

(12) United States Patent
Yu

(10) Patent No.: US 7,387,344 B2
(45) Date of Patent: Jun. 17, 2008

(54) EASY ASSEMBLY SOFA KIT

(76) Inventor: Xiaohui (Echo) Yu, No. 199, North Xinchuan Rd., Changan Town, Haining City, Zhejiang (CN)

( * ) Notice: Subject to any disclaimer, the term of this patent is extended or adjusted under 35 U.S.C. 154(b) by 236 days.

(21) Appl. No.: 11/298,794

(22) Filed: Dec. 9, 2005

(65) Prior Publication Data

US 2007/0132301 A1 Jun. 14, 2007

(51) Int. Cl.
*A47C 7/00* (2006.01)

(52) U.S. Cl. ..... 297/440.1; 297/440.15

(58) Field of Classification Search ..... 297/440.1, 297/440.14, 440.15
See application file for complete search history.

(56) References Cited

U.S. PATENT DOCUMENTS

| | | | | |
|---|---|---|---|---|
| 4,074,919 | A * | 2/1978 | Watts | 297/440.1 X |
| 7,252,339 | B2 * | 8/2007 | Owens | 297/440.1 X |
| 2002/0093235 | A1 * | 7/2002 | Niederman et al. | 297/440.1 |
| 2003/0173814 | A1 * | 9/2003 | Wieland et al. | 297/440.1 |

* cited by examiner

*Primary Examiner*—Anthony D Barfield
(74) *Attorney, Agent, or Firm*—Law Offices of Roger C. Hsu; Charles R. Sutton

(57) ABSTRACT

This invention is a kit from which a love seat type sofa can easily be assemble by a consumer at home with simple tools. It has a basal structural assembly that is an "E" shaped assembly of boards with a brace across the open part of the "E" and a board on which the seat cushions will rest, a rear structural assembly that presents the back of the sofa and the backrest against which the back cushions will rest, a number of bolts which is ideally ten, a number of pegs which is ideally four, at least one allen wrench, two arms, a base, a number of feet which is ideally four, and a number of cushions which is also ideally four. The allen wrench is adapted to drive the bolts. The basal structural assembly can be attached by bolts to the rear structural assembly. Pegs are then driven partially into the inner surfaces of the two arms using a hammer supplied by the customer. The arms are then driven onto the sides of the base and rear assemblies by means of corresponding holes into which the pegs fit. The base is fastened onto the underneath side of the assembled sofa and the feet are screwed into receiving holes on the undersides of the arms. The sofa can then be placed upright onto its feet and the two back and two seat cushions can then be installed.

2 Claims, 4 Drawing Sheets

EASY ASSEMBLY SOFA KIT

STATEMENT REGARDING FEDERALLY SPONSORED RESEARCH AND DEVELOPMENT

This invention was not made using Federally sponsored research and development. The inventor retains all rights.

CROSS-REFERENCE TO RELATED APPLICATIONS

N/A

BACKGROUND OF THE INVENTION

The semi-finished furniture market is very popular in the United States. Many people from all walks of life choose to take their furniture home in a box for home assembly rather than wait for assembly and delivery of the finished furniture. There is often a substantial savings associated with this practice since the consumer did not have to pay for the assembly and delivery of the furniture. Unfortunately, if the furniture is difficult to assemble, this practice can end up being a bad experience for the consumer. It is important, therefore, to provide furniture kits which are very easy to assemble, even for lay people.

BRIEF SUMMARY OF THE INVENTION

This invention is a kit from which a love seat type sofa can easily be assemble by a consumer at home with simple tools. It has a basal structural assembly, a rear structural assembly, a plurality of bolts, a plurality of pegs, at least one allen wrench, two arms, a base, a plurality of feet, and a plurality of cushions. The allen wrench is adapted to drive the bolts. The basal structural assembly can be attached by bolts to the rear structural assembly. Pegs are then driven partially into the inner surfaces of the two arms using a hammer supplied by the customer. The arms are then driven onto the sides of the base and rear assemblies by means of corresponding holes into which the pegs fit. The base is fastened onto the underneath side of the assembled sofa and the feet are screwed into receiving holes on the undersides of the arms. The sofa can then be placed upright onto its feet and the two back and two seat cushions can then be installed.

DETAILED DESCRIPTION OF THE INVENTION

Figure 1:
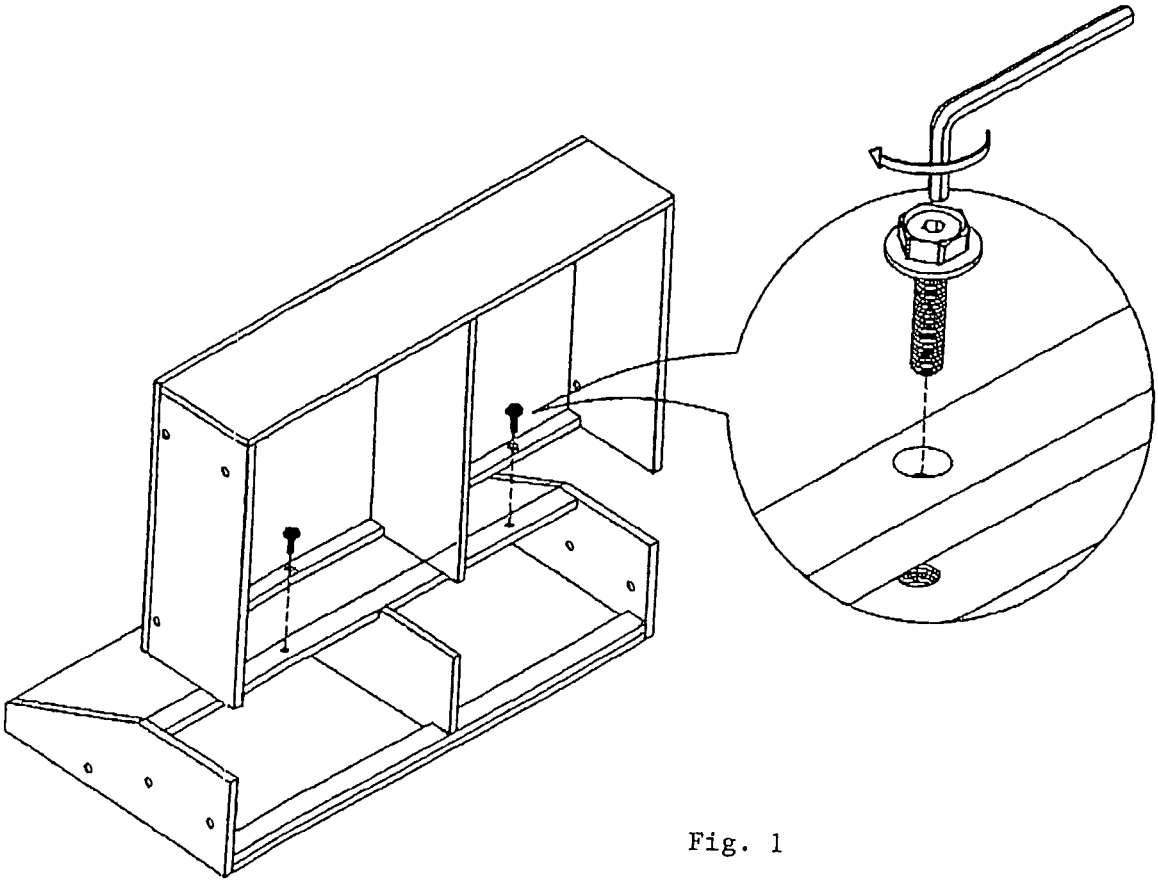
FIG. 1 is an exploded diagram showing how the basal structural assembly is bolted onto the rear structural assembly.
Figure 2:
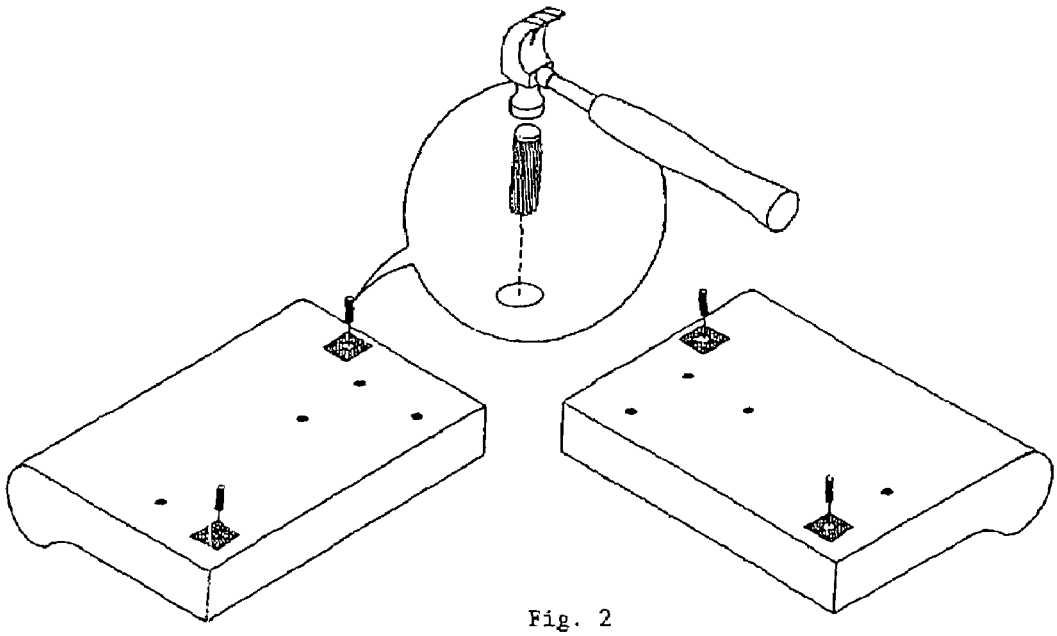
FIG. 2 is an exploded diagram that shows proper placement and installation of the pegs.
Figure 3:
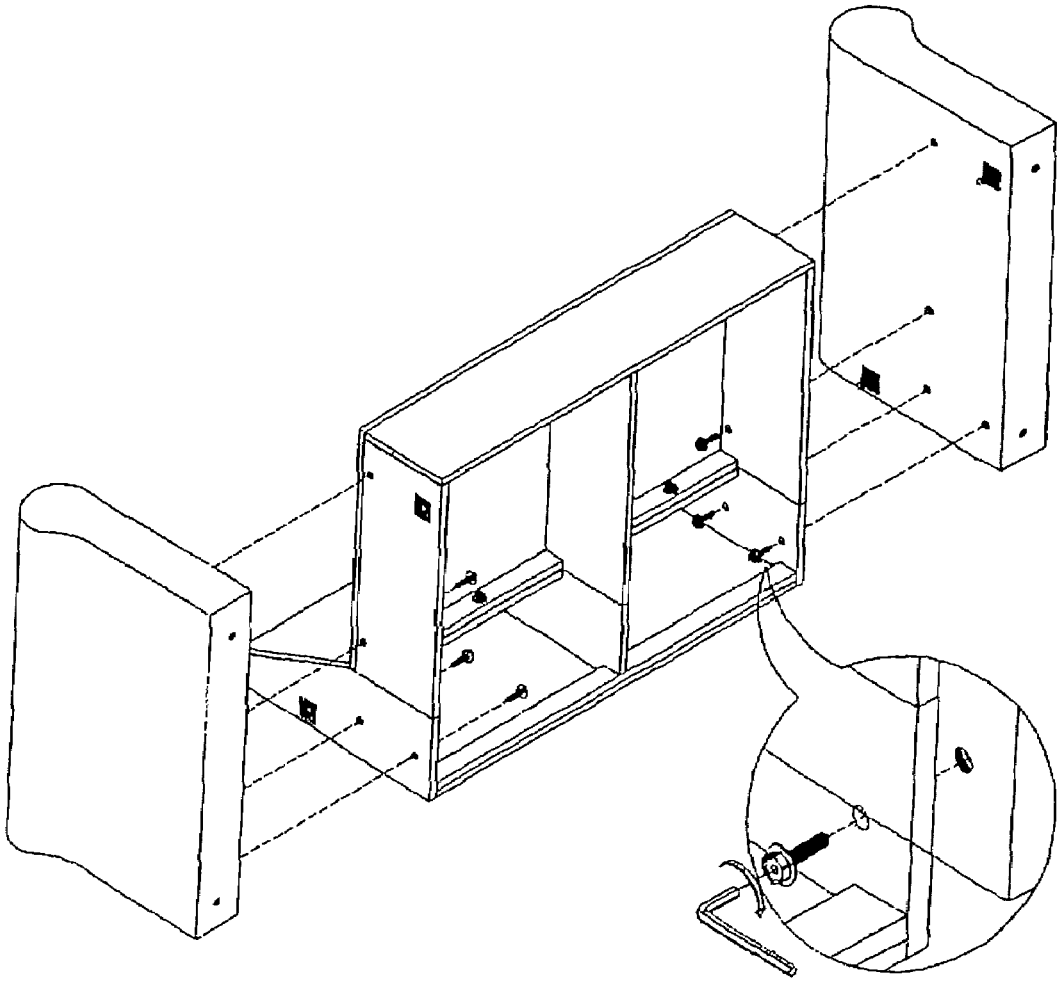
FIG. 3 is an exploded diagram that shows the relationship and installation of the arms to the basal and rear structural assemblies.
Figure 4:
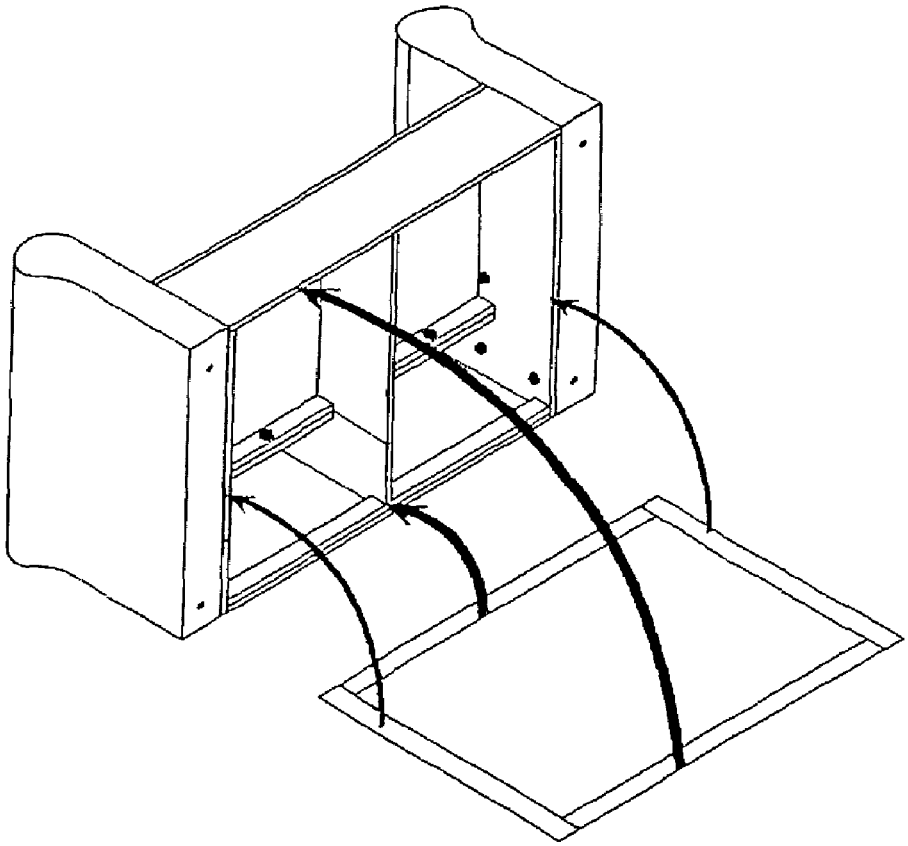
FIG. 4 is an exploded view that shows the proper placement and assembly of the base.
Figure 5:
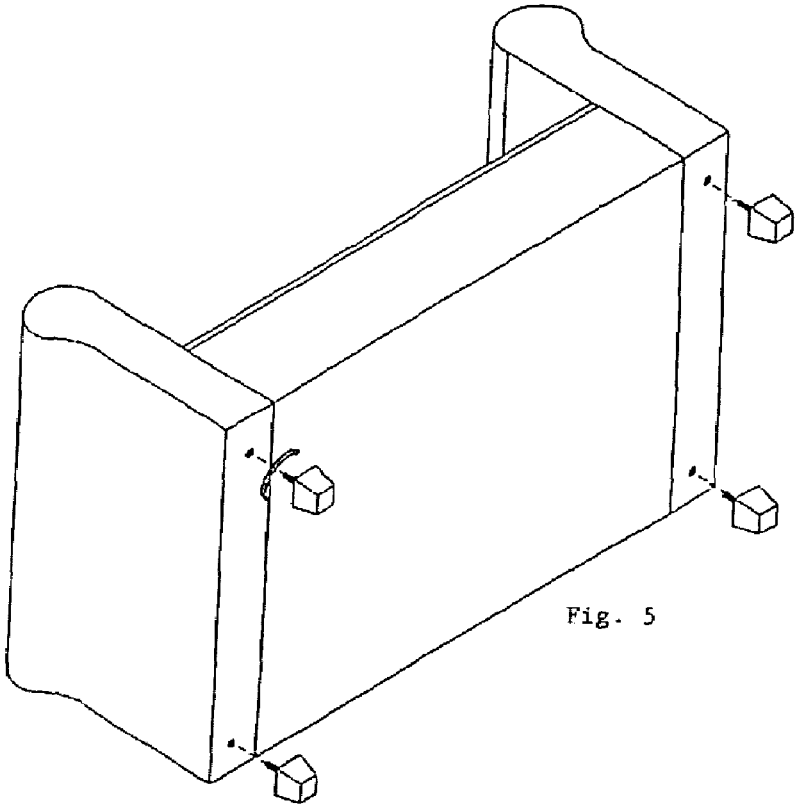
FIG. 5 is an exploded diagram that shows the proper installation of the feet.
Figure 6:
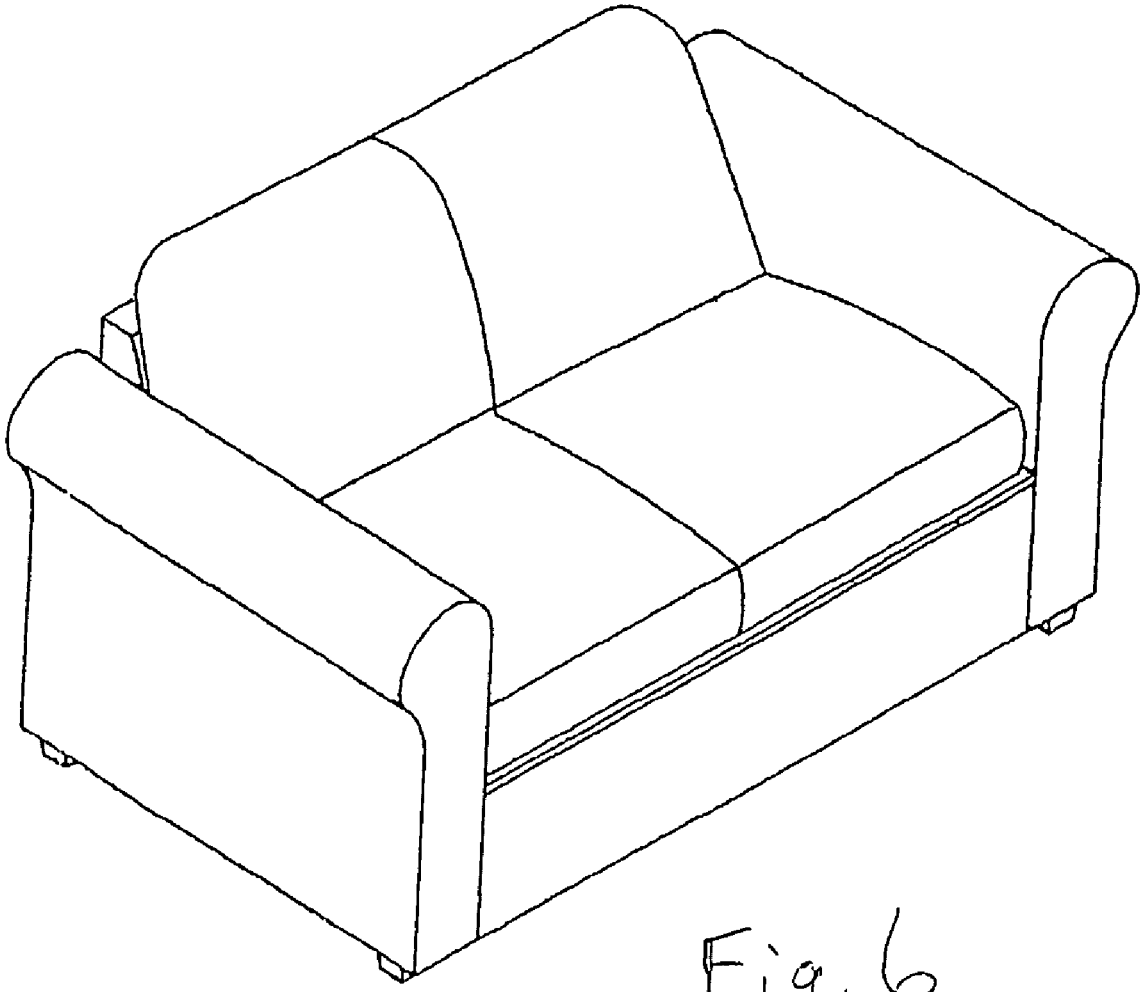
FIG. 6 is a perspective view of the love seat fully assembled.

This invention is a kit from which a love seat type sofa can easily be assemble by a consumer at home with simple tools. It has a basal structural assembly, a rear structural assembly, a plurality of bolts, a plurality of pegs, at least one allen wrench, two arms, a base, a plurality of feet, and a plurality of cushions. In the preferred embodiment there are ten bolts, four pegs, one allen wrench, four feet, and four cushions. The alien wrench is adapted to drive the bolts. The basal structural assembly can be attached by bolts to the rear structural assembly. Pegs are then driven partially into the inner surfaces of the two arms using a hammer supplied by the customer. The arms are then driven onto the sides of the base and rear assemblies by means of corresponding holes into which the pegs fit. The base is fastened onto the underneath side of the assembled sofa and the feet are screwed into receiving holes on the undersides of the arms. The sofa can then be placed upright onto its feet and the two back and two seat cushions can then be installed.

I claim:

1. A kit from which a sofa may be assembled comprising: a basal structural assembly having a first rectangular planar piece with a first edge, a second edge, a third edge, and a fourth edge, said first edge being equal in length to said third edge, said second edge being equal in length to said fourth edge; said basal structural assembly having a second rectangular planar piece, said second rectangular planar piece having a fifth edge equal in length to said first edge, said fifth edge being connected to said first edge along the entire length of said first edge, said fifth edge being connected to said first edge so said first rectangular planar piece is perpendicular to said second rectangular planar piece, said second rectangular planar piece having a sixth edge, a seventh edge, and an eighth edge, said fifth edge being equal in length to said seventh edge, said sixth edge being equal in length to said eighth edge; said basal structural assembly having a third rectangular planar piece, said third rectangular planar piece having a ninth edge equal in length to said second edge, said ninth edge being connected to said second edge along the entire length of said second edge, said ninth edge being connected to said second edge so said third rectangular planar piece is perpendicular to said first rectangular planar piece, said third rectangular planar piece having a tenth edge equal in length to said eighth edge, said tenth edge being connected to said eighth edge along the entire length of said eighth edge, said tenth edge being connected to said eighth edge so said third rectangular planar piece is perpendicular to said second rectangular planar piece, said third rectangular planar piece having an eleventh edge equal in length to said ninth edge, said third rectangular planar piece having a twelfth edge equal in length to said tenth edge; said basal structural assembly having a fourth rectangular planar piece, said fourth rectangular planar piece having a thirteenth edge, a fourteenth edge, a fifteenth edge, and a sixteenth edge, said fourteenth edge being equal in length to said sixteenth edge and also equal in length to said eighth edge, said thirteenth edge being equal in length to said fifteenth edge and said second edge, said thirteenth edge being connected to said first rectangular planar piece equidistant between said second edge and said fourth edge, said thirteenth edge being connected to said first rectangular planar piece so said fourth rectangular planar piece is parallel to said third rectangular planar piece, said fourth rectangular planar piece being connected to said first rectangular planar piece so said fourth rectangular planar piece is perpendicular to said first rectangular planar piece; said basal structural assembly having a fifth rectangular planar piece, said fifth rectangular planar piece having a seventeenth edge, an eighteenth edge, a nineteenth edge, and a twentieth edge, said eighteenth edge being equal in length to said twentieth edge and also equal in length to said eighth edge, said seventeenth edge being equal in length to said nineteenth edge and also equal in length to said second edge, said seventeenth edge being connected to said fourth edge, said seventeenth edge being connected to said fourth edge so said fifth rectangular planar piece is parallel to said third rectangular planar piece, said seventeenth edge being connected to said fourth edge so said fifth rectangular planar piece is perpendicular to said first rectangular planar piece, said seventeenth edge being connected to said fourth edge along the entire length of said seventeenth edge; said basal structural assembly having a first bracing member as long as said third edge, said first bracing member being connected to said third edge along the entire length of said third edge, said first bracing member being connected to said twelfth edge, said first bracing member being connected to said sixteenth edge, and said first bracing member being connected to said twentieth edge;

a rear structural assembly having a sixth rectangular planar piece with a twenty first edge, a twenty second edge, a twenty third edge, and a twenty fourth edge, said twenty first edge being equal in length to said third edge, said twenty third edge being equal in length to said twenty first edge, said twenty second edge being equal in length to said twenty fourth edge; said rear structural assembly having a first side planar piece with a twenty fifth edge and a twenty sixth edge, said twenty fifth edge and said twenty sixth edge being parallel to each other, said twenty fifth edge being equal in length to said twenty second edge, said twenty fifth edge being connected to said twenty second edge so said first side planar piece is perpendicular to said sixth rectangular planar piece; said rear structural assembly having a second side planar piece with a twenty seventh edge and a twenty eighth edge, said twenty seventh edge and said twenty eighth edge being parallel to each other, said twenty seventh edge being equal in length to said twenty fourth edge, said twenty seventh edge being connected to said twenty fourth edge so said second side planar piece is perpendicular to said sixth rectangular planar piece and parallel to said first side planar piece; said rear structural assembly having a second bracing member substantially equal in length to said twenty first edge and connected at distal ends to said twenty sixth edge and said twenty eighth edge;

arms;

connection means; and a bottom having substantially the same shape and size as said first rectangular planar piece.

2. A method of assembling the kit of claim 1 comprising the following steps in the order presented:

a) using said connection means to attach said first bracing member to said second bracing member along the entire length of said first bracing member so that said twentieth edge meets said twenty sixth edge and said twelfth edge meets said twenty eighth edge and said first rectangular planar piece is perpendicular to said sixth rectangular planar piece;

b) using said connection means to attach said arms to said fifth rectangular planar piece, said first side planar piece, said second side planar piece, and said third rectangular planar piece so that said fifth rectangular planar piece and said first side planar piece are both connected a particular arm and said second side planar piece and said third rectangular planar piece are both connected to a particular arm;

c) attaching said bottom to said nineteenth edge, said seventh edge, said fifteenth edge, and said eleventh edge so that said bottom is parallel to said first rectangular planar piece.

* * * * *